US005700991A

United States Patent [19]

Osbern

[11] Patent Number: 5,700,991

[45] Date of Patent: Dec. 23, 1997

[54] HEATING DEVICE FOR HEATING A GEL CONTAINER RECEIVED THEREIN

[76] Inventor: Lida N. Osbern, 1774 E. 1200 Rd., Lawrence, Kans. 66049

[21] Appl. No.: 637,401

[22] Filed: Apr. 25, 1996

Related U.S. Application Data

[63] Continuation of Ser. No. 208,433, Mar. 9, 1994, abandoned.

[51] Int. Cl.[6] ..... F27D 11/00

[52] U.S. Cl. ..... 219/430; 219/214; 219/386; 219/432; 219/433; 222/146.5

[58] Field of Search ..... 219/521, 214, 219/385, 386, 430, 432, 433, 429; 392/477; 222/146.5, 146.2; 34/202

[56] References Cited

U.S. PATENT DOCUMENTS

| | | | |
|---|---|---|---|
| 1,373,116 | 3/1921 | Bunce | 219/521 |
| 1,977,482 | 10/1934 | Klause | 219/430 |
| 2,006,059 | 6/1935 | Rudorff | 219/521 |
| 2,090,666 | 8/1937 | Copeland | 219/521 |
| 2,292,992 | 8/1942 | Crouch | 219/521 |
| 2,413,176 | 12/1946 | Deaton | 219/521 |
| 2,604,573 | 7/1952 | Raines et al. | 219/521 |
| 2,955,191 | 10/1960 | Galgano et al. | 219/521 |
| 3,075,299 | 1/1963 | Bennett et al. | 34/202 |
| 3,152,245 | 10/1964 | Litman | 219/521 |
| 3,266,674 | 8/1966 | Martin | 219/214 |
| 3,432,641 | 3/1969 | Welke | 219/521 |
| 3,454,745 | 7/1969 | Stone | 219/432 |
| 3,601,581 | 8/1971 | Cone | 219/386 |
| 3,712,512 | 1/1973 | Snider, Jr. et al. | 222/67 |
| 3,904,086 | 9/1975 | Losenno | 222/146.5 |
| 4,011,992 | 3/1977 | Olsen | 239/135 |
| 4,282,003 | 8/1981 | Yashin et al. | 219/541 |
| 4,612,106 | 9/1986 | Kromer et al. | 204/182.8 |
| 4,959,528 | 9/1990 | Malloy | 219/432 |
| 5,057,671 | 10/1991 | Colson | 219/521 |
| 5,066,377 | 11/1991 | Rosenbaum et al. | 204/182.8 |
| 5,080,195 | 1/1992 | Mizumoto et al. | 184/6.4 |
| 5,136,684 | 8/1992 | Lonker et al. | 392/392 |
| 5,240,147 | 8/1993 | Frazier et al. | 222/325 |
| 5,244,124 | 9/1993 | Raffo | 222/325 |
| 5,549,543 | 8/1996 | Kim | 392/433 |

FOREIGN PATENT DOCUMENTS

| | | | |
|---|---|---|---|
| 994293 | 11/1951 | France | 219/521 |
| 998302 | 1/1952 | France | 219/433 |
| 545801 | 11/1930 | Germany | 34/202 |
| 478310 | 2/1953 | Italy | 219/433 |
| 6607499 | 1/1967 | Netherlands | 219/432 |

*Primary Examiner*—Geoffrey S. Evans
*Assistant Examiner*—Raphael Valencia
*Attorney, Agent, or Firm*—Chase & Yakimo

[57] ABSTRACT

A device for heating a gel used in physical examinations or on the instruments therefor, e.g. a pelvic examination, comprises a heat reservoir in communication with a flue which receivably receives the gel container therein. The container presents a valve operable by the physician's elbow to preclude the need to manipulate the device in order to dispense the gel. Rotation of the container in the flue is precluded by a ridge array restraining movement between the container and flue. The flue/reservoir combination design prevents toppling of the device during use. Hygienical dispensing of a warmed gel onto the user's hands is provided without user manipulation required.

5 Claims, 6 Drawing Sheets

HEATING DEVICE FOR HEATING A GEL CONTAINER RECEIVED THEREIN

This application is a continuation of application Ser. No. 08/208,433, filed Mar. 9, 1994, now abandoned.

BACKGROUND OF THE INVENTION

This invention relates to medical devices, and more patrticularly, to a dispenser which efficiently and hygienically dispenses a warmed lubricant/gel for use by a physician in rectal/genital examinations.

The frequency of performance of genital/rectal examinations upon female patients being admitted into a hospital has been found to be low, various studies indicate that such examinations are omitted for various physician and patient-related reasons. Patient objections were raised as to examination discomfort including cold stirrups, speculum and lubricating gel. The use of a cold lubricating gel during the rectal/genital examination exacerbates the leading patient complaint of discomfort during the examination process. Accordingly, it is desirable to provide a device which addresses at least this leading problem.

Various methods have been utilized to warm the cold gel. Such methods include wrapping the gel container in heating pads, immersion of the container in hot water and shining a heating lamp on the gel conttainer. However, such methods are relatively cumbersome and do not effectively and hygienically address the cold gel problem.

In response thereto I have provided a device which efficiently presents a warmed gel to the physician in a hygienic manner so as to remove at least the primary factor attributable to patient discomfort accompanying a pelvic examination. My device efficiently dispenses a warmed lubricating gel onto the physician's hands in a hygienic manner. As such the use of my device in medical facilities will increase the performance of the pelvic exam during standard physical examinations.

It is therefore a general object of this invention to provide a medical device which efficiently and hygienically presents a warm gel to the physician for use during pelvic examinations.

Another object of this invention is to provide a device, as aforesaid, which reduces the discomfort experienced by the patients during rectal/genital or pelvic examinations.

A further object of this invention is to provide a device, as aforesaid, which efficiently and safely warms a gel/lubricant to a desired temperature.

Another particular object of this invention is to provide a device, as aforesaid, which dispenses the warmed gel from a cartridge onto the physician's hands without the need to manipulate the device.

A further particular object of this invention is to provide a device, as aforesaid, which allows the physician to dispense the heated gel from a cartridge by elbow depression of a valve without fear of toppling the device.

Other objects and advantages of this invention will become apparent from the following description taken in connection with the accompanying drawings, wherein are set forth by way of illustration and example, a now preferred embodiment of this invention.

DESCRIPTION OF THE PREFERRED EMBODIMENT

Figure 1:
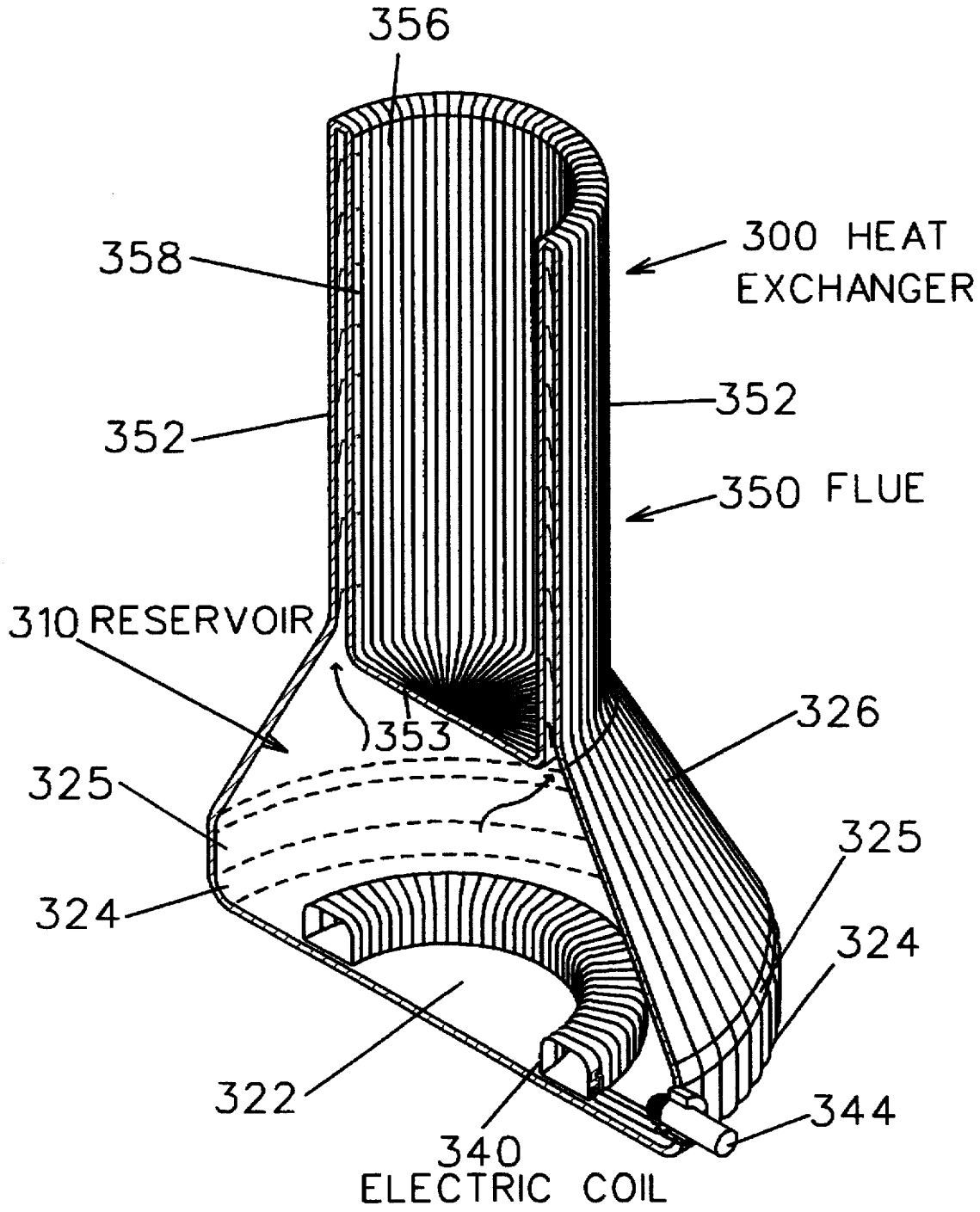
FIG. 1 is a perspective view of the thermolube device, a portion of the heating reservoir being sectioned along the center line thereof, showing the interior heating coil and surrounding fluid resevoir.
Figure 2:
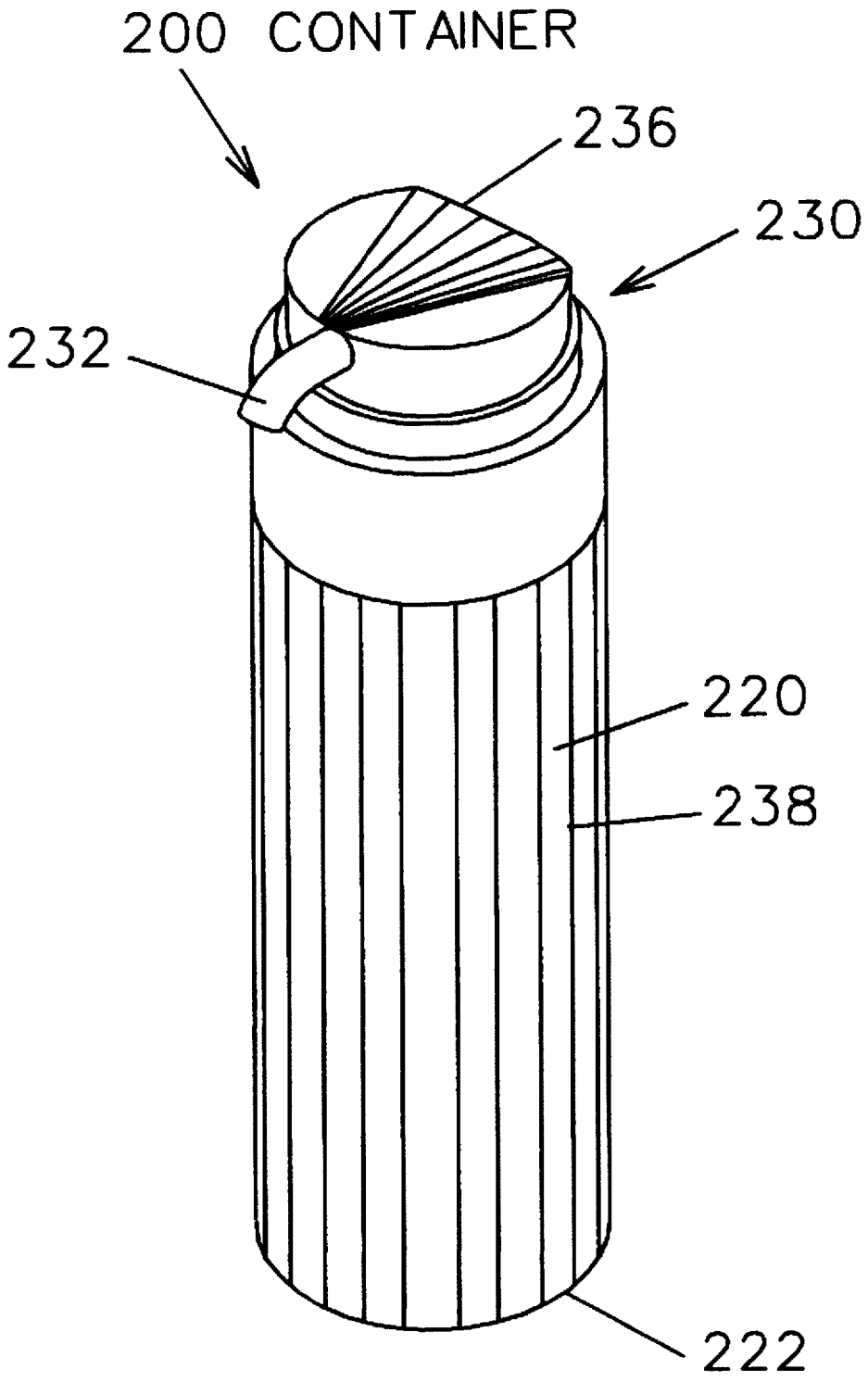
FIG. 2 is a view of the gel dispensing container as removed from the flue of the heating container.

Turning more particularly to the drawings, FIGS. 1 and 2 illustrate the device 10 as generally comprising a gel dispensing cartridge/container 200 designed for insertion into a heat exchanger 300.

The heat exchanger 300, as shown in FIG. 1, is preferably made of a plastic material. The exchanger 300 generally comprises a lower heating reservoir 310 positioned below the container 200 storage area/flue 350. The configuration of the heat reservoir 310 presents a circular base 322 with a vertical wall 324 upwardly extending therefrom. Extending from the top edge 325 of vertical wall 324 is a conical surface 326 which is directed towards the vertical wall 352 which forms the flue 350 for the gel container 200. The diameter of the circular base 322 is larger than the diameter of the flue 350. This relationship precludes the heat exchanger 300 from tipping upon exertion of forces on the flue 350. Moreover the extension of the conical surface 325 towards the flue 350 directs the heat in the reservoir 310 towards the base 353 of the flue 350 and through the upwardly extending channel 356. This relationship enhances the resulting heat exchange with the gel container 200 positioned within flue 350.

Figure 3:
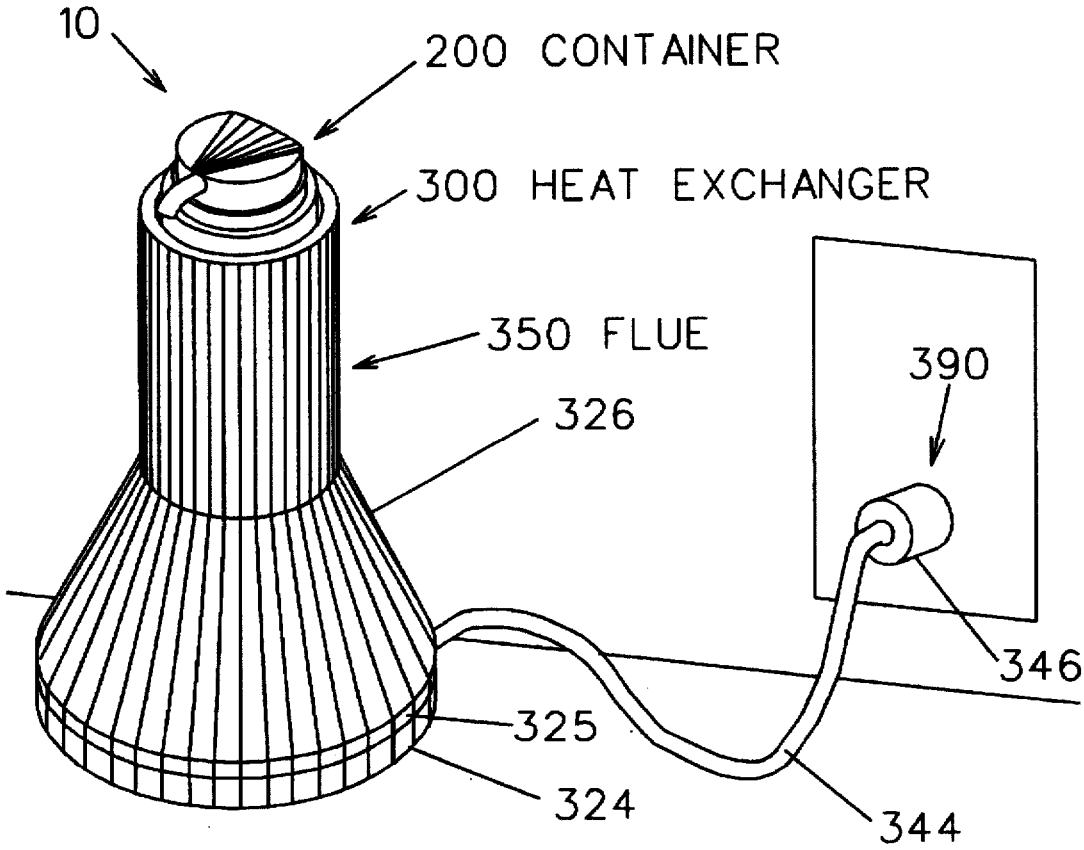
FIG. 3 is an illustrative view showing the thermolube device awaiting use.
Figures 4, 5:
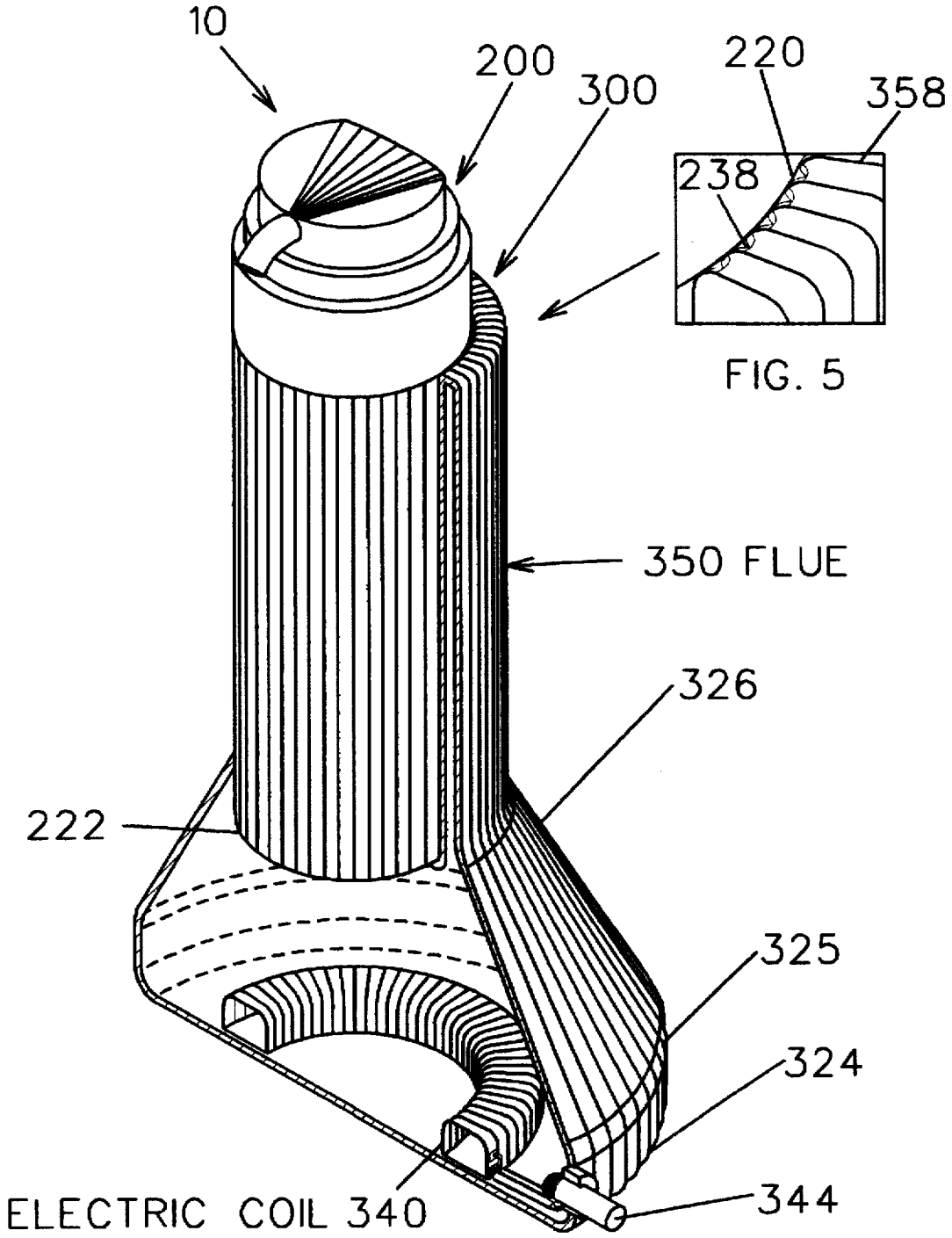
FIG. 4 is a perspective view of the heating device, as in FIG. 1, on a reduced scale, with an unsectioned gel container shown in place.
FIG. 5 is a fragmentary view, on an enlarged scale, showing a portion of the ridges on the gel container cooperating with the internal ridges of the flue.
Figure 6:
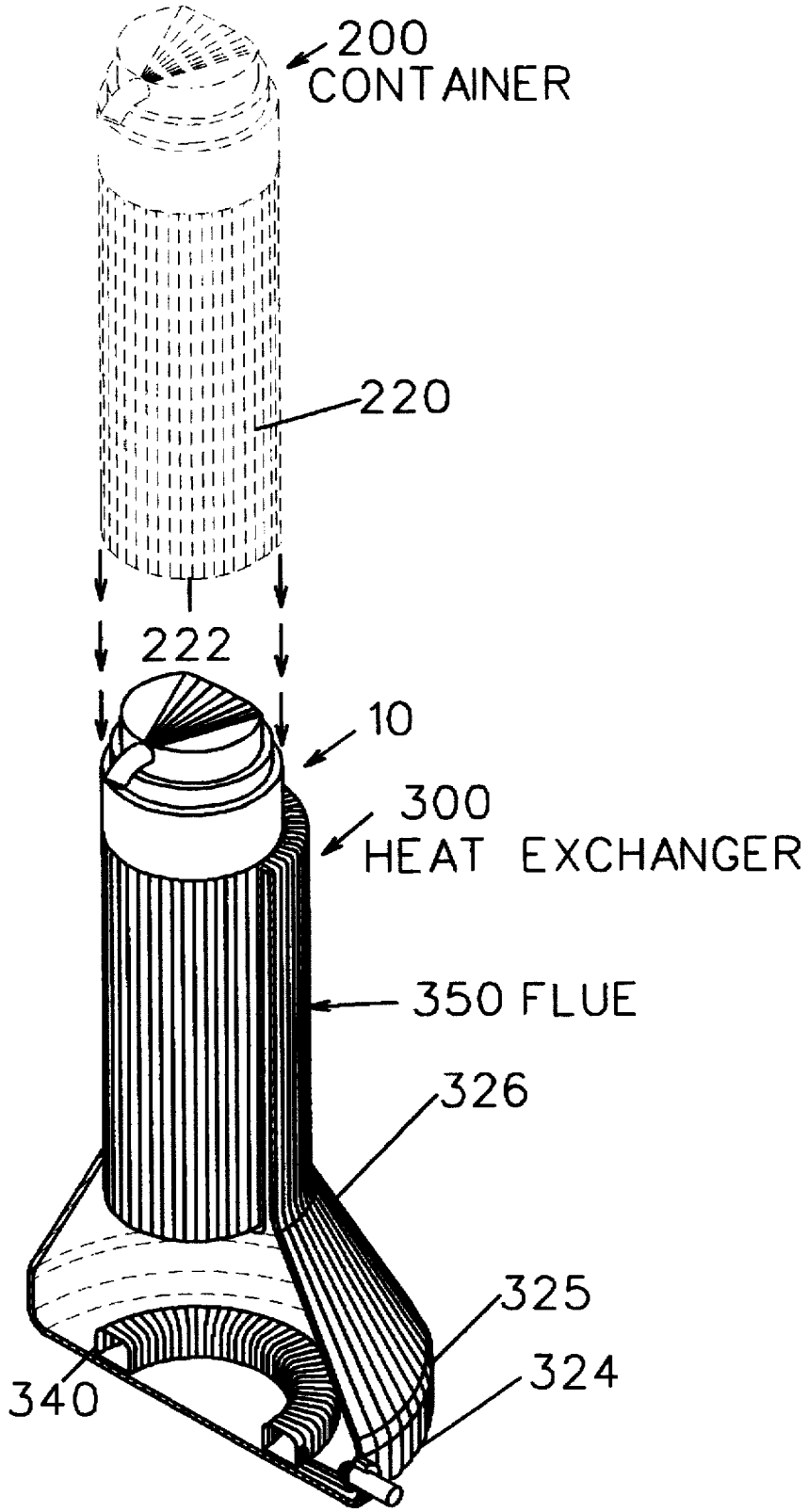
FIG. 6 is a view, as in FIG. 4, showing entry of the gel container into the flue.
Figure 7:
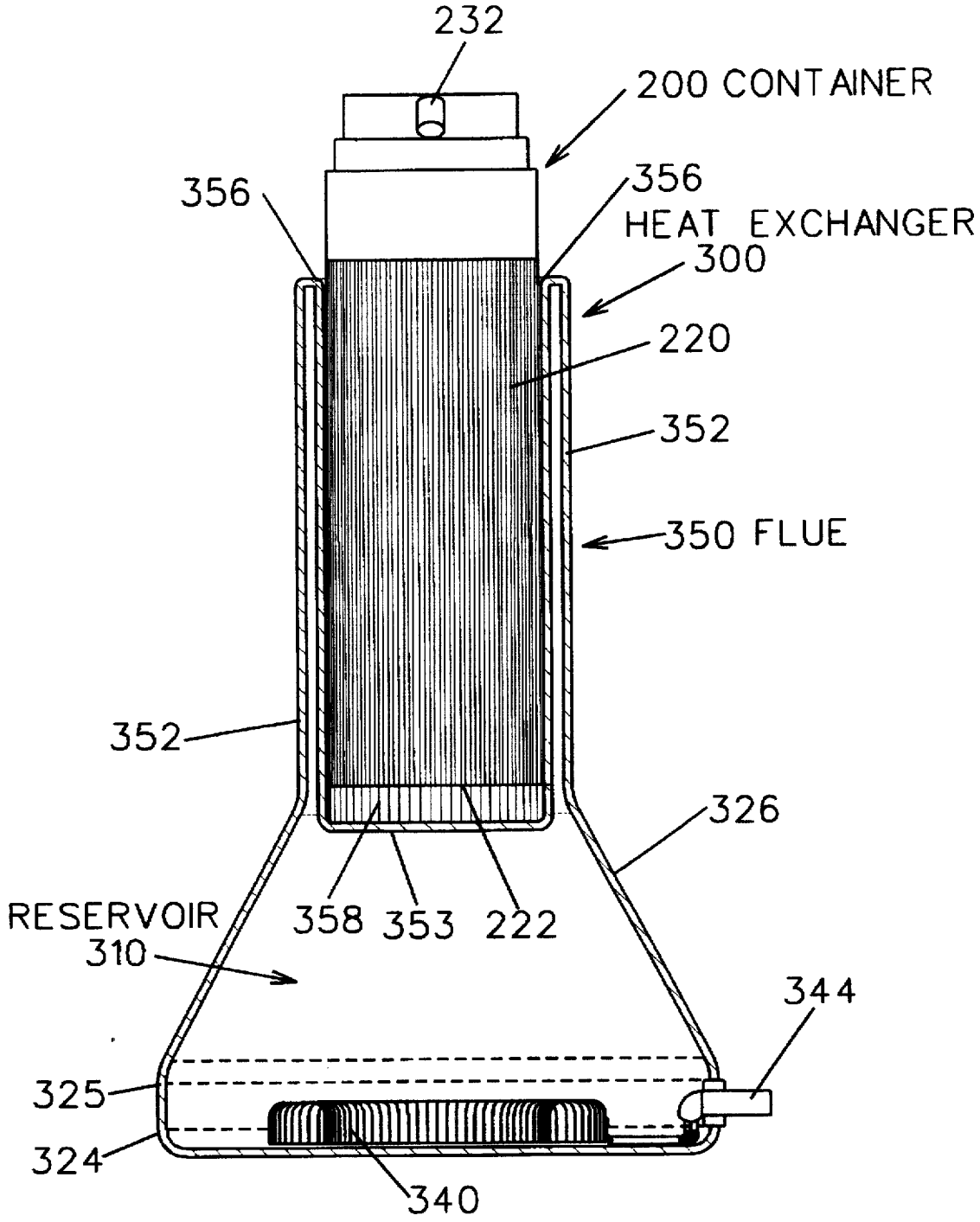
FIG. 7 is an elevation view of the heating device of FIG. 1 with the gel container being partially displaced from the flue base for purposes of illustration.

Located atop the inner surface of the base 322 is a heating coil 340 with thermostat preferably set at 38 degrees C.°±1 degree. A wire 344 extends from the heat reservoir 310 for connection with an electrical source such as through plug 346 connected to socket 390. (FIG. 3).

Inserted within the heat reservoir 310 is a heat exchange fluid, such as vegetable oil or the like. The heat from coil 340 is transferred thereto upon delivery of an electric current to the coil 340.

Upwardly extending from the heat reservoir 310 is the flue 350. The flue 350 comprises a circular lower base 353 with an upwardly extending channel wall 356 terminating at an upper inlet 370. The circular outer wall 352 insulates the container 200 upon insertion therein. Inlet 370 atop the flue 350 presents an inside diameter allowing for the insertion of the cartridge container 200 therein.

As shown in the drawings, heat from the fluid reservoir 310 is transferred to the flue base 353 and between the flue walls 352, 356 for conduction to the adjacent surface of the container 200 cylinder 222 embedded within flue 350.

The container 200, as shown in FIG. 2, comprises a cylinder 220 having a lower base 222 and an upper fluid spout 232 as controlled by a release valve 236. The gel is conventionally inserted in the cylinder 220 under pressure such that the depression of the valve 236 dispenses the gel through spout 232. The valve surface preferably presents an area which is responsive to forces thereon as exerted by the physician's elbow.

A series of ridges 238 longitudinally extend along the surface of the cylinder 220. These ridges 238 are positioned between the ridges 358 found within the interior of the flue 350. Accordingly, upon insertion of the container 200 within the flue 350, rotation of the container within fluid is restricted by the cooperating ridges 238, 358. During depression of the valve 236 the spout 232 is thus restricted to its initial relative position within flue 350.

in use, the physician prior to performing the pelvic examination, can now Use a heated gel approaching that of the patient's body temperature so as to diminish the patient discomfort. Ejection of the gel from the container 200 is provided upon depression of the valve 236 by the elbow or the like. The above described configuration of the container 200, heat reservoir 310 and flue 350 stabilizes the device during elbow depression. Moreover, the desired spout 232 position is maintained due to the cooperating ridges 238, 358. As such the physicians hand(s) is/are free to receive the gel thereon from the spout 232 without fear of tipping the device. Moreover, the gel can be hygienically dispensed as the physician need not manipulate any surfaces of the device 10.

Although any form of this invention has been illustrated and described, it is understood that it is not to be limited thereto except as set forth in the following claims and allowable functional equivalents thereof.

I claim:

1. A heating device for warming a gel comprising:

a heat reservoir comprising:

a generally flat base having an inner face and an outer face for placement atop a supporting surface;

a generally upstanding wall extending about said base;

a conical surface extending from said wall and having an upper end generally directed to a central flue above said base;

a thermostatically controlled heating coil mounted atop said inner face of said base;

means for providing power to said heating coil;

a fluid in said reservoir and in contact with said powered coil in a heat exchange relationship therewith;

said central flue being positioned atop said heat reservoir comprising:

a lower base vertically displaced from said flat reservoir base and generally surrounded by said upper end of said conical surface, said conical surface extending from said flue base towards said reservoir base;

a channel formed by an inner wall upwardly extending from said lower flue base and presenting a lower end at said lower base of said flue and a top end vertically displaced from said lower base of said flue;

an inlet at said top end of said channel;

an outer wall generally displaced in parallel from said inner wall, said outer wall having a lower end joined to said upper end of said conical surface and a top end joined to said top end of said inner wall, said displacement of said outer wall from said inner wall forming a passage about said channel between said lower and top ends of said inner and outer walls, said passage in communication with said reservoir;

a container adapted to contain gel to be warmed, said container configured for insertion through said flue inlet and having a gel containing portion in contact with said inner wall, said container further comprising:

a spout at the top of said container;

user operable valve means at the top of said container adapted to direct gel through said spout, said flue and container therein being in a heat exchange relationship with said fluid, whereby heat from said reservoir is directed to said flue base and passage for transfer to said container surrounded by said flue whereby to warm the gel in said container;

means in said flue for precluding movement of said container in said flue during operation of said valve means, said preclusion means comprising:

a series of parallel ridges vertically extending along said inner wall of said flue between said lower end and top end of said flue;

a series of ridges along said container, said ridges of said container positioned between the ridges on said inner wall of said flue to diminish rotation between said flue and said container.

2. The heating device as claimed in claim 1, wherein said conical surface directs the heat emanating from said fluid towards said flue.

3. The heating device as claimed in claim 1, wherein said reservoir base presents a surface area greater than a cross-sectional area of said lower base of said flue, whereby to preclude toppling of said flue during operation of said valve means.

4. The heating device as claimed in claim 1, wherein said valve means presents a surface for depression by a user, said surface enhancing user manipulation of said device.

5. A heating device for warming a gel comprising:

a heat reservoir comprising:

a generally flat base having an inner face and an outer face for placement atop a supporting surface;

a general conical surface extending from said base and having an upper end generally directed to a central flue above said base;

a thermostatically controlled heating coil mounted atop said inner face of said base;

means for providing power to said heating coil;

a fluid in said reservoir and in contact with said powered coil in a heat exchange relationship therewith;

said central flue being positioned atop said heat reservoir comprising:

a lower base vertically displaced from said flat reservoir base and generally surrounded bysaid upper end of said conical surface, said conical surface extending from said flue base towards said reservoir base;

a channel formed by an inner wall upwardly extending from said lower flue base and presenting a lower end at said lower base of said flue and a top end vertically displaced from said lower base of said flue;

an inlet at said top end of said channel;

an outer wall generally displaced in parallel from said inner wall, said outer wall having a lower end joined to said upper end of said conical surface and a top end joined to said top end of said inner wall, said displacement of said outer wall from said inner wall forming a passage about said channel between said lower and top ends of said inner and outer walls, said passage in communication with said reservoir;

a container adapted to contain gel to be warmed, said container configured for insertion through said flue inlet and having a gel containing portion in contact with said inner wall, said container further comprising:

a spout at the top of said container;

user operable valve means at the top of said container adapted to direct gel through said spout, said flue and container therein being in a heat exchange relationship with said fluid, whereby heat from said reservoir is directed to said flue base and passage for transfer to said container surroundedby said flue wherebyto warm the gel in said container;

means in said flue for precluding movement of said container in said flue during operation of said valve means, said preclusion means comprising:

a series of parallel ridges vertically extending along said inner wall of said flue between said lower end and top end of said flue;

a series of ridges along said container, said ridges of said container positioned between the ridges on said inner wall of said flue to diminish rotation between said flue and said container.

* * * * *

UNITED STATES PATENT AND TRADEMARK OFFICE

CERTIFICATE OF CORRECTION

PATENT NO. : 5,700,991

DATED : December 23, 1997

INVENTOR(S) : Lida N. Osbern

It is certified that error appears in the above-identified patent and that said Letters Patent is hereby corrected as shown below:

Column 1, line 26, delete "conttainer" and substitute --container--.

Signed and Sealed this

Tenth Day of March, 1998

Bruce Lehman

*Attest:*

BRUCE LEHMAN

*Attesting Officer*

*Commissioner of Patents and Trademarks*